US005244379A

United States Patent [19]

Stirling et al.

[11] Patent Number: 5,244,379

[45] Date of Patent: Sep. 14, 1993

[54] CONTROL SYSTEM FOR A GAS COOKING DEVICE

[75] Inventors: Robert W. Stirling, Englewood; Gary L. Mercer, Eaton, Ohio

[73] Assignee: Henny Penny Corporation, Eaton, Ohio

[21] Appl. No.: 760,483

[22] Filed: Sep. 16, 1991

Related U.S. Application Data

[63] Continuation-in-part of Ser. No. 644,346, Jan. 22, 1991, abandoned.

[51] Int. Cl.[5] ..... F23N 5/24

[52] U.S. Cl. ..... 431/6; 431/15; 431/1; 431/12

[58] Field of Search ..... 431/1, 14, 2, 15, 20, 431/27, 28, 24, 25, 26, 6

[56] References Cited

U.S. PATENT DOCUMENTS

| | | | |
|---|---|---|---|
| 2,800,176 | 7/1957 | Morrison | 43/70 |
| 3,603,707 | 9/1971 | Stantz | 431/16 |
| 3,644,074 | 2/1972 | Cade | 431/26 |
| 3,830,619 | 8/1974 | Cade | 431/78 |
| 3,847,533 | 11/1974 | Riordan | 431/78 |
| 3,872,320 | 3/1975 | Juskewicz, Jr. | 431/69 X |
| 4,156,432 | 5/1979 | Helwig, Jr. | 431/78 X |
| 4,192,641 | 3/1980 | Nakagawa et al. | 431/15 |
| 4,243,373 | 1/1981 | Fernstrom et al. | 431/66 |
| 4,260,362 | 4/1981 | Matthews | 431/69 |
| 4,303,385 | 12/1981 | Rudich, Jr. et al. | 431/70 |
| 4,324,542 | 4/1982 | Challet | 431/71 |
| 4,325,689 | 4/1982 | Burke | 431/70 |
| 4,382,770 | 5/1983 | Pinckaers | 431/26 |
| 4,402,663 | 9/1983 | Rommanelli et al. | 431/66 |
| 4,444,551 | 4/1984 | Mueller et al. | 431/25 |
| 4,445,841 | 5/1984 | Tanaka et al. | 431/27 |
| 4,452,582 | 6/1984 | Portasik | 43/27 |
| 4,459,097 | 7/1984 | Riordan et al. | 431/25 |
| 4,518,345 | 5/1985 | Mueller et al. | 431/24 |
| 4,560,343 | 12/1985 | Bohan, Jr. | 431/66 |
| 4,581,697 | 4/1986 | Jamieson et al. | 431/46 |
| 4,604,046 | 8/1986 | Mueller et al. | 431/2 |
| 4,672,324 | 6/1987 | van Kampen | 431/25 |
| 4,695,246 | 9/1987 | Beilfuss et al. | 431/31 |
| 4,913,038 | 4/1990 | Burkett et al. | 99/331 |
| 4,925,386 | 5/1990 | Donnelly et al. | 431/28 |
| 4,930,488 | 6/1990 | Pearman et al. | 426/39 E |
| 4,955,806 | 9/1990 | Grunden et al. | 431/24 |

*Primary Examiner*—Carl D. Price
*Attorney, Agent, or Firm*—Baker & Botts

[57] ABSTRACT

A system is disclosed for monitoring the output of a gas ignition module used for controlling the heating of a cooking device, such as a deep fat fryer, in a pulsed heating mode. The system includes a controller which detects a failure in ignition and alerts the user of the cooking device of such a failure. In a preferred embodiment, an optoisolator is used to monitor the voltage applied to a gas valve. From this determination, the system logically determines when a gas lockout has occurred, and prevents successive ignition attempts, which could result in an unwanted accumulation of gas.

28 Claims, 5 Drawing Sheets

CONTROL SYSTEM FOR A GAS COOKING DEVICE

RELATED U.S. APPLICATION

This application is a continuation-in-part application of U.S. patent application Ser. No. 644,346 to Stirling et al., abandoned filed Jan. 22, 1991.

BACKGROUND OF THE INVENTION

The present invention relate to a control system for monitoring and controlling a gas cooking device, and more particularly, to a control system for monitoring and controlling a gas ignition module operating in a pulsed heating mode.

THE PRIOR ART

Gas ignition modules that employ flame sensing devices to disconnect or lockout the gas supply on flame failure are known in the art. Upon flame failure, the gas supply is locked out to prevent unwanted accumulation of gas. However, these gas ignition modules, including the lockout sensing elements, are reset when power to the gas ignition module is removed. In conventional (non-pulsed) gas heating systems, this characteristic does not pose a problem since power is continuously supplied to the gas ignition modules. Thus, feedback of information related to gas lockout or ignition failure was not needed in older control schemes because the control system would apply power to the gas ignition module continuously, thus allowing the lockout system to function properly.

More recently, control systems that pulse the gas control module have been developed because of the superior control of the heating process they provide. Such a cooking device and control system for a deep fat fryer is disclosed in U.S. Pat. No. 4,913,038 issued to Burkett et al. In that control system, a heating element can be operated in the "full-on" or pulsed mode.

The traditional lockout system does not function well in conjunction with a pulsed control system. Every time the pulsed control system disconnects power to the gas ignition module, all systems contained therein (including the lockout system) are reset. Therefore, when power is supplied to the gas ignition module on the next pulse, the system is unaware of the previous lockout, and allows a pulse of gas to enter the combustion area. If there is no flame, lockout would then occur. However, the lockout condition will be reset when power is withdrawn from the gas ignition module. Thus, after repeated pulsing, substantial gas accumulation can occur in the combustion area. Therefore, the traditional lockout mechanism to prevent unwanted accumulation of gas does not function properly in a pulsed gas cooking system.

SUMMARY OF THE INVENTION

Accordingly, it is a general object of the invention to prevent accumulation of gas during attempted ignition by a gas ignition module.

It is another object of the present invention to provide a control system for a cooking device to control the supply of pulsed power to a gas ignition module and utilize conventional gas ignition modules while preventing unwanted accumulation of gas.

It is a more specific object of the invention to provide a control system for a cooking device for preventing successive ignition attempts by a conventional gas ignition module after ignition lockout has occurred.

In order to achieve these and other objects of the present invention, there is provided a control system for controlling the supply of power to a gas ignition module in a pulsed manner. The gas ignition module controls the ignition of gas from a gas valve, which may be used to heat a cooking medium in a fryer. The control system employs a software subroutine called a Gas Module Update Routine. An output of the gas ignition module is sensed, and this information is used by the update routine to determine if a lockout has occurred. More particularly, when the system is operating in the pulsed mode, every preselected pulse is set for a duration sufficiently long to capture the entire ignition sequence. Thus, power to the gas ignition module is constant when the determination is made as to whether a lockout has occurred. This allows the system to accurately determine lockout. This information is used to prevent the system from attempting subsequent ignition attempts if a lockout has been detected. Subsequent ignition attempts could result in an undesired accumulations of gas. Further, the system warns the user of the abnormal condition.

BRIEF DESCRIPTION OF THE DRAWINGS

These and other objects, features and advantages of the invention, as well as the invention itself, will become better understood by reference to the following detailed description when considered in connection with the accompanying drawings wherein.

DESCRIPTION OF PREFERRED EMBODIMENTS

Figure 1:
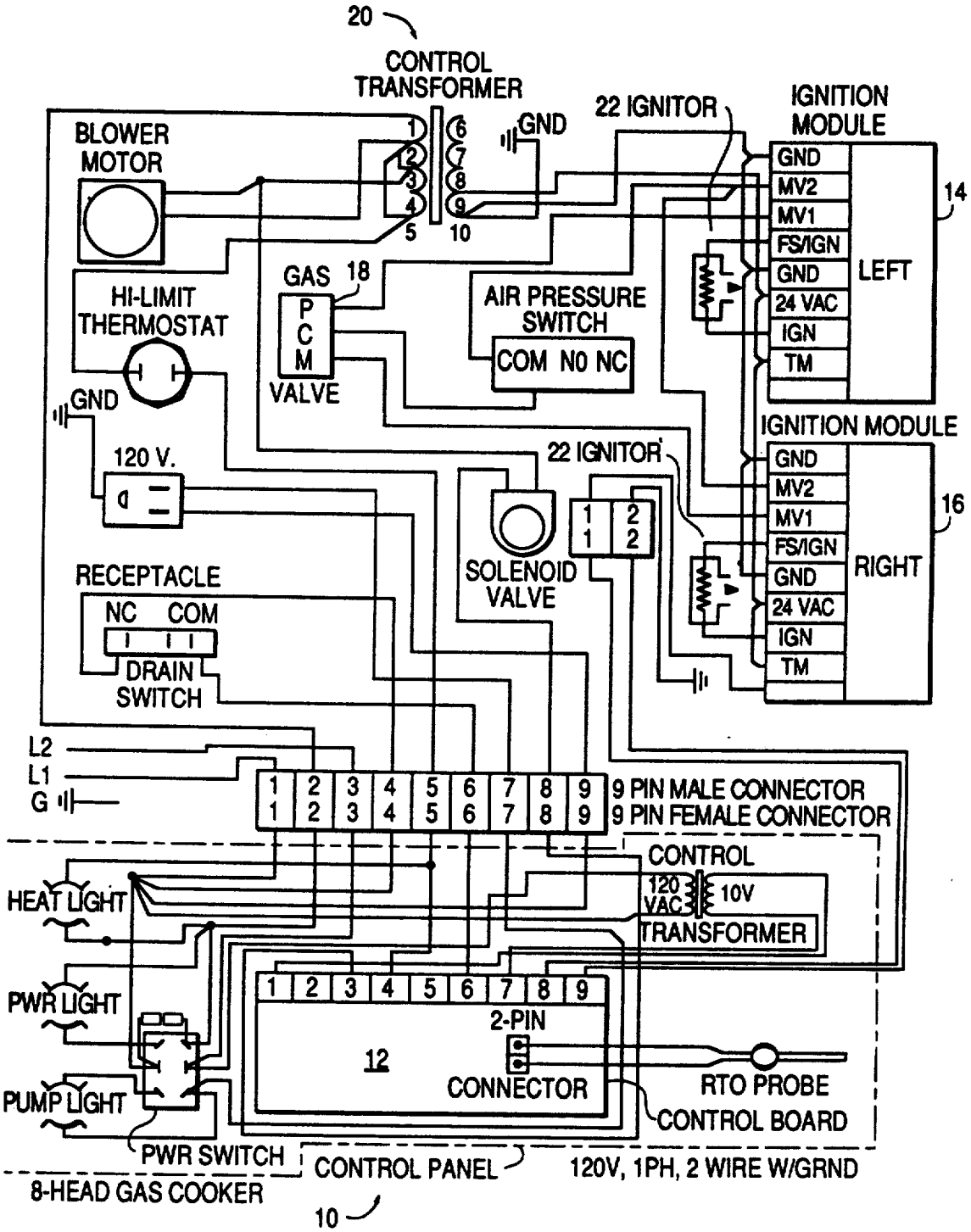
FIG. 1 is a schematic diagram of a gas ignition module interconnected to a control board.

Referring to FIG. 1, a schematic diagram of a control system for an 8-head gas fryer is shown. Included therein are left and right gas ignition modules 14 and 16, respectively. The output of the right gas ignition module 16 is shown connected to pins 8 and 9 of a control board 12. The structure and operation of the control system (FIG. 2) contained inside the control board 12 as well as the gas ignition modules 14 and 16 will be described in detail. The remaining conventional circuit elements will not be discussed in detail. Typical gas ignition modules are the Series 05-31 manufactured by Fenwal, Inc. of Ashland, Mass. Pins MV1 and MV2 are the main valve output pins of the gas ignition module. Pin MV2 is tied common between the left and right gas ignition modules 14 and 16. The FS/IGN pin serves two purposes. First, during attempted ignition, it outputs 24 volts to the ignitor. Second, the FS/IGN pin is used to monitor for flame rectification during flame sensing.

Control transformer 20 supplies 24VAC to the 24VAC pins of the left and right gas ignition modules 14 and 16. This voltage is used as input to the ignitor IGN and the gas valve outputs MV1. Control transformer 20 is a step-down transformer that converts either 120 V or 240 V down to 24 V, which is required by gas ignition modules 14 and 16.

In the present invention, only the right gas ignition module 16 is monitored. If an ignition failure was to occur in the left gas ignition module 14, it would turn off its output to the 2-valve gas valve 18. Both valves of gas valve 18 have to be on to get a gas output. Pins 8 and 9 of control board 12 are used to monitor the output of the right gas ignition module 16. The control board contains a controller which is shown by the block diagram of FIG. 2.

When power is applied to the gas ignition module, it activates ignitor 22. Subsequently, gas valve 18 is turned on and releases gas to be ignited when it hits ignitor 22. Gas ignition module 16 also has a flame sensing circuit which senses, through what is commonly known as flame rectification, whether a flame has been established. In the system of the present invention, the power to the gas ignition modules 14 and 16 may be pulsed so as to create more controlled heating. As described above, this pulsed mode of operation results in the gas ignition modules 14 and 16 being reset after each pulse, thus allowing gas to accumulate during each failed attempt at ignition.

Figure 2:
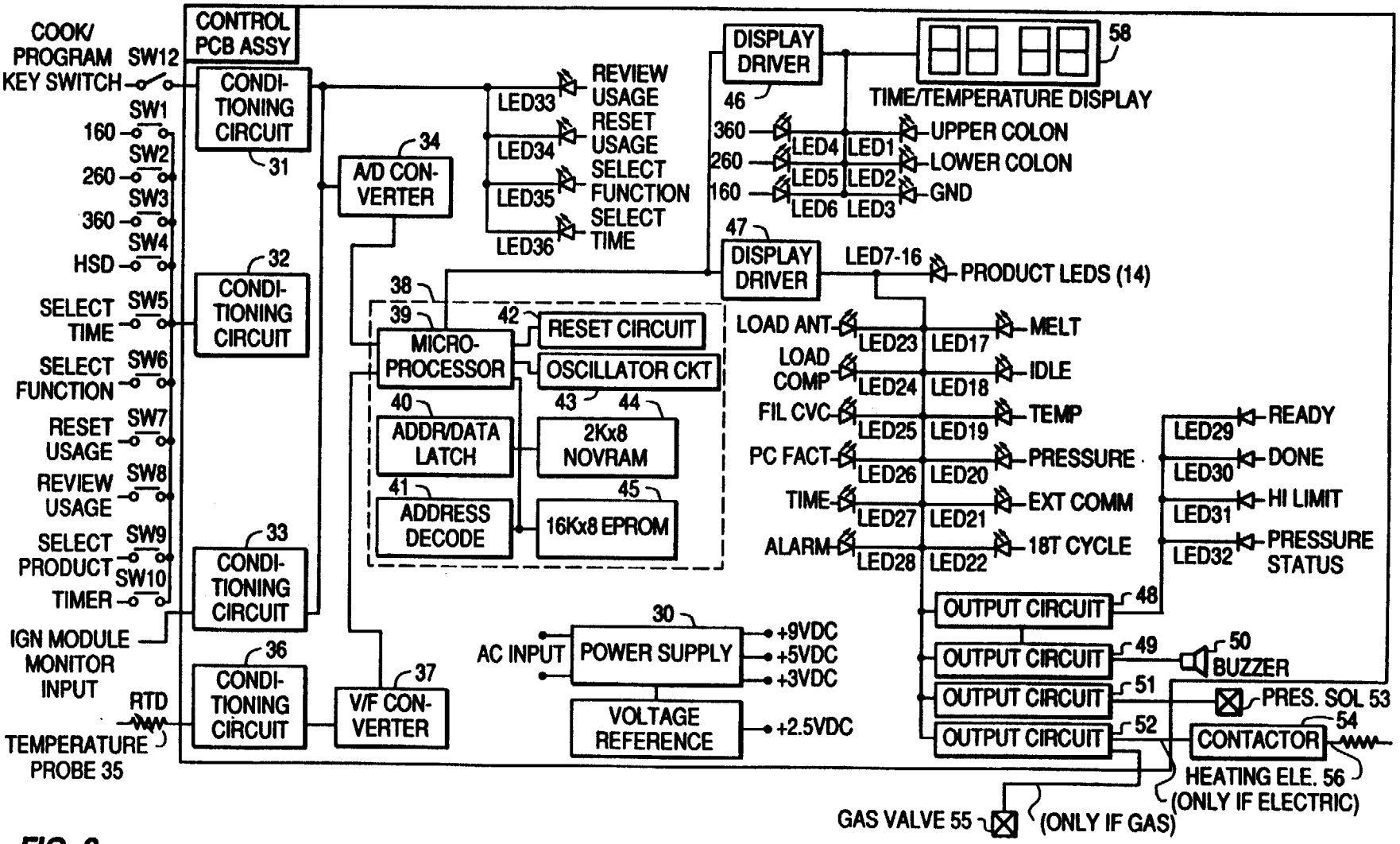
FIG. 2 is a circuit diagram for the controller of the present invention.

A normal ignition of the gas system can be described as follows:

a) The system controller calls for ignition by energizing its output driver (described below in FIG. 2).

b) The gas ignition module reacts by outputting 24 VAC into the control system conditioning circuit (element 33 in FIG. 2). This 24 volts results in the power being applied to the gas ignition module while the gas valve relay is de-energized, and allows for the necessary ignitor preheating prior to activation of the gas valve relay.

c) After the preheat period, the gas ignition module output goes low, and the gas valve is energized. When the gas contacts with the ignitor, ignition will occur if the system is operating properly.

When an ignition failure occurs, the gas ignition module de-energizes the gas valve relay and simultaneously energizes the 24 volt input to the gas ignition module monitoring system of the present invention.

With reference to FIG. 2, there is shown a circuit diagram for the controller of the present invention. It is to be understood that this circuit diagram is but one suitable embodiment for carrying out the present invention. The controller is described in detail. However, particular attention is directed to the sensing of the output of the right gas ignition module 16 by the conditioning circuit 33 and its use by the software described below in regard to FIGS. 3, 4 and 5.

Element 30 refers generally to a power supply and voltage reference. The power supply may be a standard power supply with an AC input and may comprise adjustable and fixed voltage regulators to provide a plurality of voltages at, for example, 9, 5, and 3 volts DC. The voltage reference may comprise an integrated circuit voltage reference with a fixed output of 2.5 volts.

Conditioning circuit 31 receives an input from SW12, the COOK/PROGRAM key switch. Conditioning circuit 31 comprises a pull-down resistor and four current limiting resistors for the REVIEW USAGE, RESET USAGE, SELECT FUNCTION, AND SELECT TIME bars (LEDs 33–36).

The membrane switch conditioning circuit 32 receives input from SW1–SW10 and may comprise a resistor ladder network made up of eight resistors.

Conditioning circuit 33 receives an input from the ignition module monitor input (terminals 8 and 9 in FIG. 1), and may comprise two 1.5 K dropping resistors, one H11AA1 optoisolator, a pull down resistor and a noise filter capacitor. The A/D converter 34 may comprise an ADC0811C IC converter and a bypass capacitor. A/D converter 34 receives inputs from conditioning circuits 31, 32 and 33. The purpose of the optoisolator in conditioning circuit 33 is to translate the 24 V signal from the gas ignition module down to a 5 V logic signal. It also provides isolation from noise in the system. The optoisolator monitors the voltage (24 V) applied to the gas valve and logically determines when a gas lockout has occurred. This information is used to prevent the gas ignition module from trying successive ignition attempts that could result in an accumulation of gas from unsuccessful ignition attempts. The software used to logically determine if a lockout has occurred is described below with reference to FIGS. 3, 4 and 5.

A temperature probe 35 may comprise a 1,000 ohm platinum thin RTD and provides an input to conditioning circuit 36. Conditioning circuit 36 may comprise a voltage divider and a capacitor for noise control. The output of conditioning circuit 3 provides an input to V/F converter 37 which may comprise an AD654 IC converter. Further, a resistor, potentiometer and capacitor are provided to set full scale output frequency. The converters 34 and 37 provide inputs to microprocessor 39 which is discussed below.

As indicated by the hatched box 38, the CPU core comprises a MC6803 microprocessor 39, a 74LS373 address/data latch 40, an address decoder 41, a reset circuit 42, an oscillator circuit 43, a 2K×8 NOVRAM (48Z02) 44 for storing cooking parameter data and a 16K×8 EPROM (27C128) 45 that contains the program for the control system. One function of decoder 41 is to generate enable signals for NOVRAM 44 and EPROM 45. The particular components listed herein are for example only; other components may also be used with the invention.

Reset circuit 42 comprises two resistors forming a voltage divider of the 9-volt supply, and an amplifier, for example, a LM224 quad op-amp package, wired as a comparator. The reset circuit 42 may further include a MOSFET (VLN2222), a reset resistor and capacitor, and three diodes (1N914) as well as a resistor for switching the reset select voltages.

Oscillator circuit 43 may comprise, for example, a 4.000 MHz crystal and two compensation capacitors. Display drivers 46 and 47 each comprise a MM5450 IC driver, and a resistor and capacitor to set the output current limit.

Output circuit 48 may comprise, for example, a 10 K resistor DIP and a ULN2003 IC buffer. Output circuit 48 serves as a driver for LEDs 29–32. Output circuit 49 is a buzzer output circuit which may comprise a switching transistor (2N3904), three resistors to bias the transistor, and a diode (1N914) to increase the volume of the buzzer. Element 5 is a buzzer which may be used to indicate an abnormal condition or provide other signals to an operator.

Output circuits 51 and 52 may each comprise a MOC3041 triac driver, current limiting resistors, a MAC3040 triac, pull up resistors and a snubber network formed of a resistor and a capacitor.

Output circuit 51, responsive to the operation of CPU 38, may be used to activate a pressure solenoid 53 during the cook operation to selectively enable a user to cook with or without pressure. Output circuit 52, also responsive to CPU 38, may have two outputs. One output is used for an electrical heating element; the other is used for a gas heating element Of course, this invention applies mainly to gas driven heating elements, and the gas accumulations that can occur when they are used.

For the other details of the controller of FIG. 2, its functions, and a detailed description of the overall computerized control system used in conjunction with a deep fat fryer, attention is directed to U.S. Pat. No. 4,913,038, issued to Burkett et al. The teachings of the '038 patent are hereby incorporated by reference.

Figure 3:
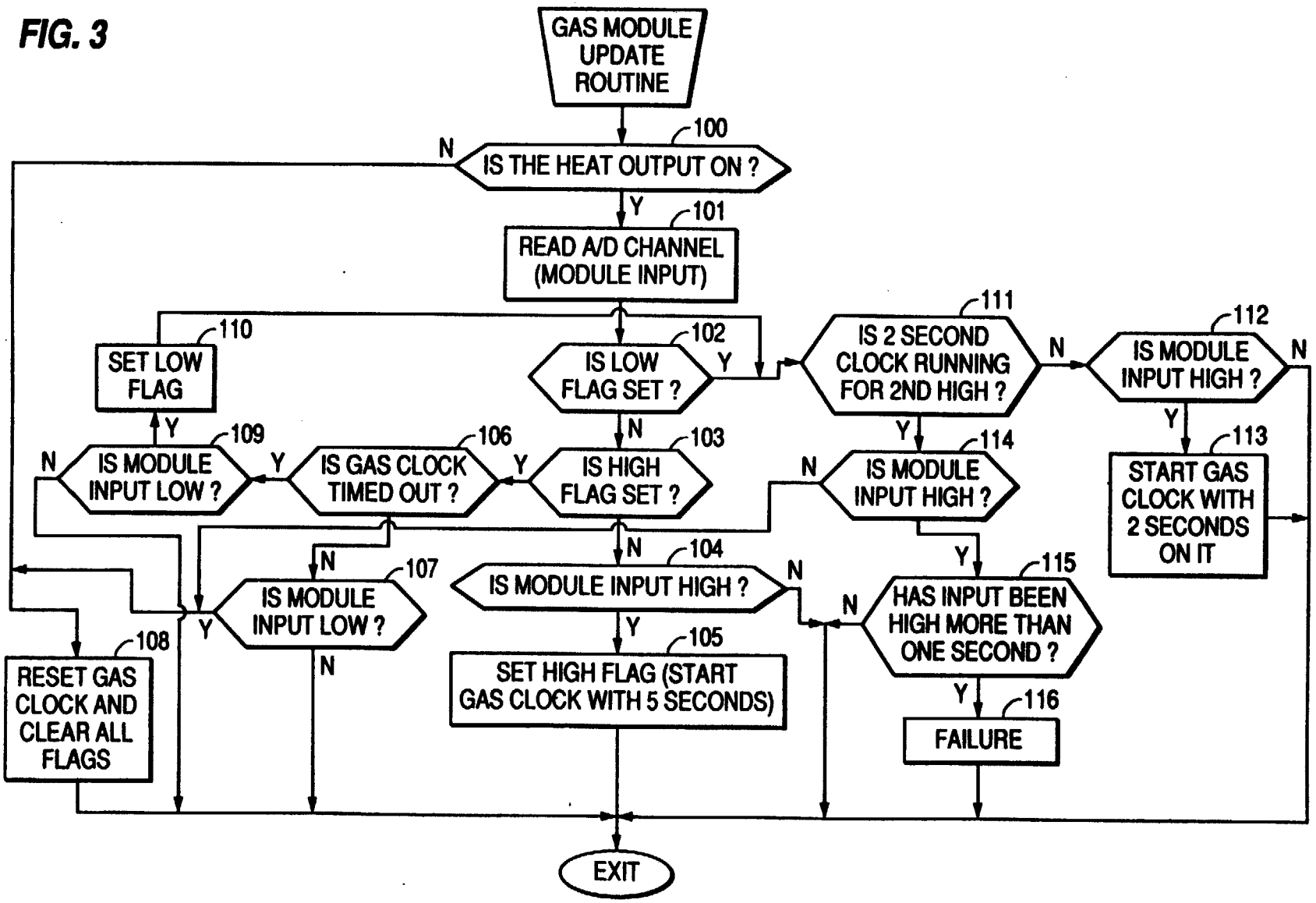
FIG. 3 is a flow chart of a Gas Module Update Routine according to a first embodiment of the invention.

The flowchart of FIG. 3 describes the assembly code, which is attached as Appendix 1, for a Gas Module Update Routine for use with a first embodiment of the invention. The assembly code for the mainline routine follows the Update Routine. This assembly code is stored in the 16K×8 EPROM 45 of FIG. 2. The Update Routine is called up each time through the main line program. As described above, a proper ignition is indicated by an initial low voltage sensed by the ignition module monitor followed by high voltage when the heating is initiated. After the preheat period, the voltage sensed at the ignition module monitor should be low again and should stay low for proper operation. Improper operation would be indicated by a high voltage sensed after the preheat period.

When the system controller is set for proportional heat (pulsed heat), every preselected pulse, for example, every sixth pulse, is set for a duration of, for example, 16 seconds (regardless of the calculated pulse length). This allows for a period of time necessary to capture the entire gas module ignition sequence. Of course, other pulse lengths may be sufficient to capture the entire gas module ignition sequence. This can be easily implemented in the control system of the present invention by incrementing a counter each time a pulse is given to the gas ignition module. Once the sixth pulse is reached (regardless of what its pulse length should be), its length is made sufficient to perform the error checking. Therefore, power is continuously applied to the gas ignition module during the gas module update routine.

The update routine begins in step 100 by determining if the heat output is on. This senses whether a controller has turned on the heat to the cooking device, for example, a deep fat fryer. If not, then control proceeds to step 108 where the gas clock and all flags are reset. Control then returns to the mainline process control routine. If the heat is on in step 100, then control proceeds to step 101 where the output of the A/D converter (34 in FIG. 2) is read. In step 102, during the first time through the Gas Module Update Routine, the low flag is not set, thus control proceeds to step 103 where the high flag is also not set the first time through the routine. In step 104 the module input to the controller should be high to indicate the gas ignition module is in the preheat stage, after the heat is initially turned on. If it is high, then proceed to step 105 where the high flag is set to indicate that preheating has or is taking place. The clock is then set for 5 seconds. This period of time for the gas clock corresponds to the preheat period. Different time periods could be set for gas modules using different preheat periods. This time period lasts for the duration of the preheat period where no failure can occur because ignition has not yet been attempted.

The next time through the update routine at step 103, the high flag is detected. Then, in step 106, it is determined whether the gas clock has expired, which would indicate the end of the preheat period. If the gas timer has not expired, then step 107 determines if the module input has gone low this time through the update routine. If not, control exits the update routine and proceeds through the mainline routine. If the module monitor input has gone low at step 107, this indicates that the power may have been interrupted to the fryer. In this case, control proceeds to step 108 where all flags and the gas clock are reset, and mainline processing continues. If the gas clock timer has expired in step 106, this indicates the end of the preheat period for the gas ignition module. In that case, control proceeds to step 109 where a determination is made as to whether the module input is low.

If the module input is low in step 109 (which indicates a proper operation) then the low flag is set in step 110 to indicate the end of the preheat period, and control proceeds to step 111. In step 111 it is determined if a two-second clock is running. The first time step 111 is reached the two-second clock will not be running. At step 112, it is determined if the module input is high. If not, proper operation of the gas ignition module is indicated, and control exits the update routine. If the module input is high at step 112, this indicates that a failure may have occurred. However, the failure should be present for a certain duration to avoid having spikes being detected as failures. Thus, control proceeds to step 113 and the two-second gas clock started. The time for the gas clock could be any appropriate value. The next time through the update routine, at step 111, the two-second clock will be running. Therefore control will proceed to step 114.

In successive steps 114 and 115, a high module input which has a duration of greater than one second, would be indicative of failure. This will prevent any sudden spikes from indicating a failure. Thus, in step 116, an error message will be given to the user, and further pulsing of the gas ignition module will be prevented. When a failure has occurred, the system controller enters an alarm condition which can be manually reset by depressing any of the system controller selection keys.

Figure 4:
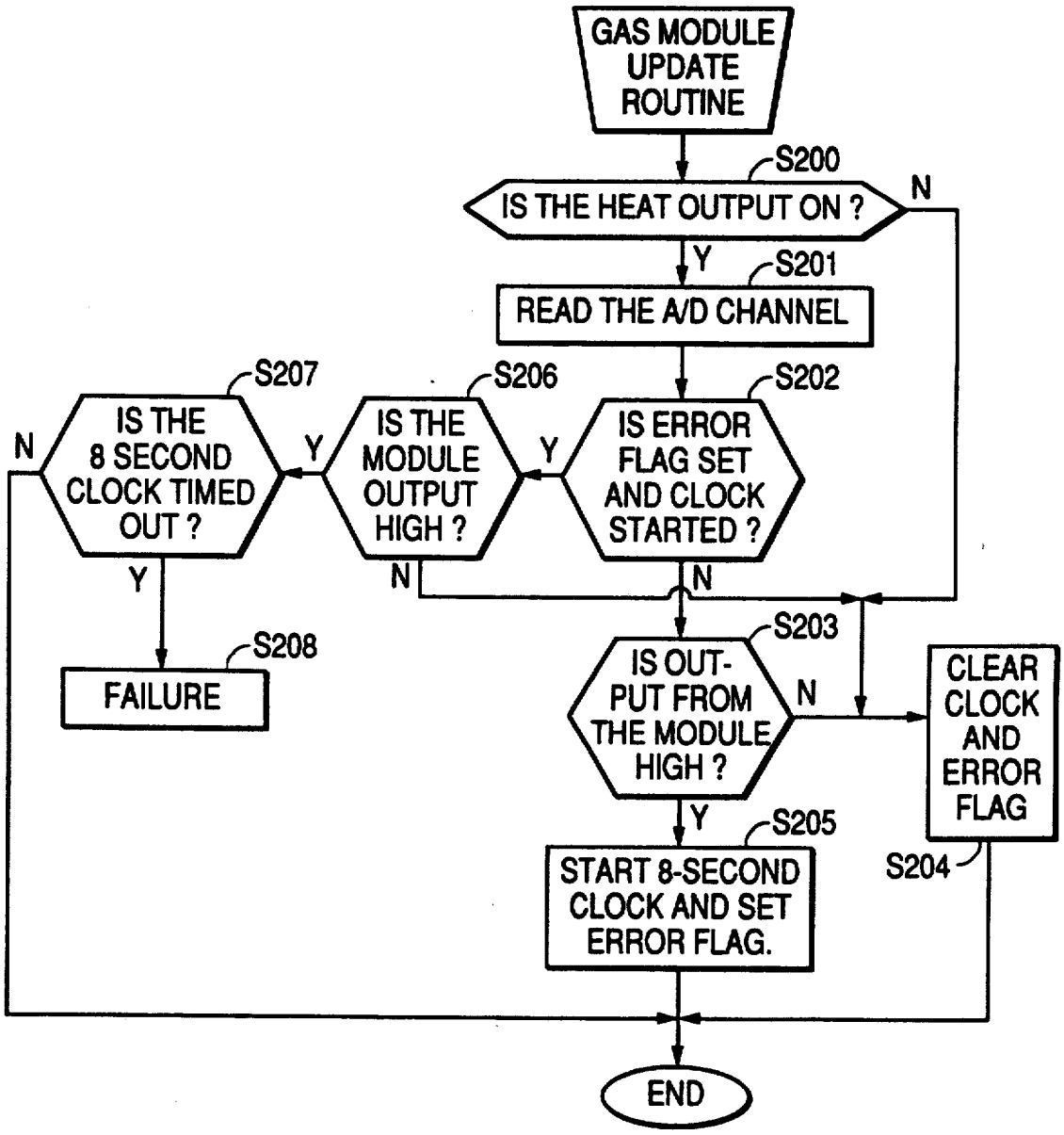
FIG. 4 is a flow chart of a Gas Module Update Routine according to a second embodiment of the invention.

A flowchart for the Gas Update Routine for use in conjunction with a second embodiment of the invention is shown in FIG. 4.

In accordance with the second embodiment of the invention the controller senses a lockout signal of greater than eight seconds in duration. This determination results in an alarm indicating to the user the existence of an abnormal condition and also prevents further pulsing of the gas ignition module. This embodiment is to be distinguished from the first than one second in duration after the end of the preheat period. This simplification of the second embodiment has been found to provide satisfactory results while simplifying the software requirements.

Referring to FIG. 4, steps 200 and 201 are the same as steps 100 and 101 in the first embodiment. Step 202 asks if the error flag is set high and the gas clock started. This step determines if a lockout condition has previously been detected. The first time through the routine, of course, a lockout condition will not have been previously detected. In that case, control moves to step 203 where the presence of a lockout condition is determined. If lockout is not present, control passes to step 204 where all flags and the clock are cleared, and mainline processing continues. If lockout is determined in step 203, an eight-second clock is activated and the error flag is set high in step 205.

On the next pass through the update routine, at step 202, it will be determined that the error flag has been set and clock started. Control will then pass to step 206 where it will be determined whether a lockout condition continues to exist. If not, the error flag and clock will be cleared in step 204 and control will return to the mainline routine. If lockout is indicated in step 206, then a determination as to whether it has existed for eight seconds will be made in step 207. If not, control will return to the mainline routine. However, the error flag will still be set, and the clock will continue to run. If the eight-second clock has timed out, this will indicate that a lockout signal has been present for eight seconds. Thus, a failure has occurred. That failure is indicated in step 208. Further ignition attempts are then prevented, and the user is notified of the failure.

Figure 5:
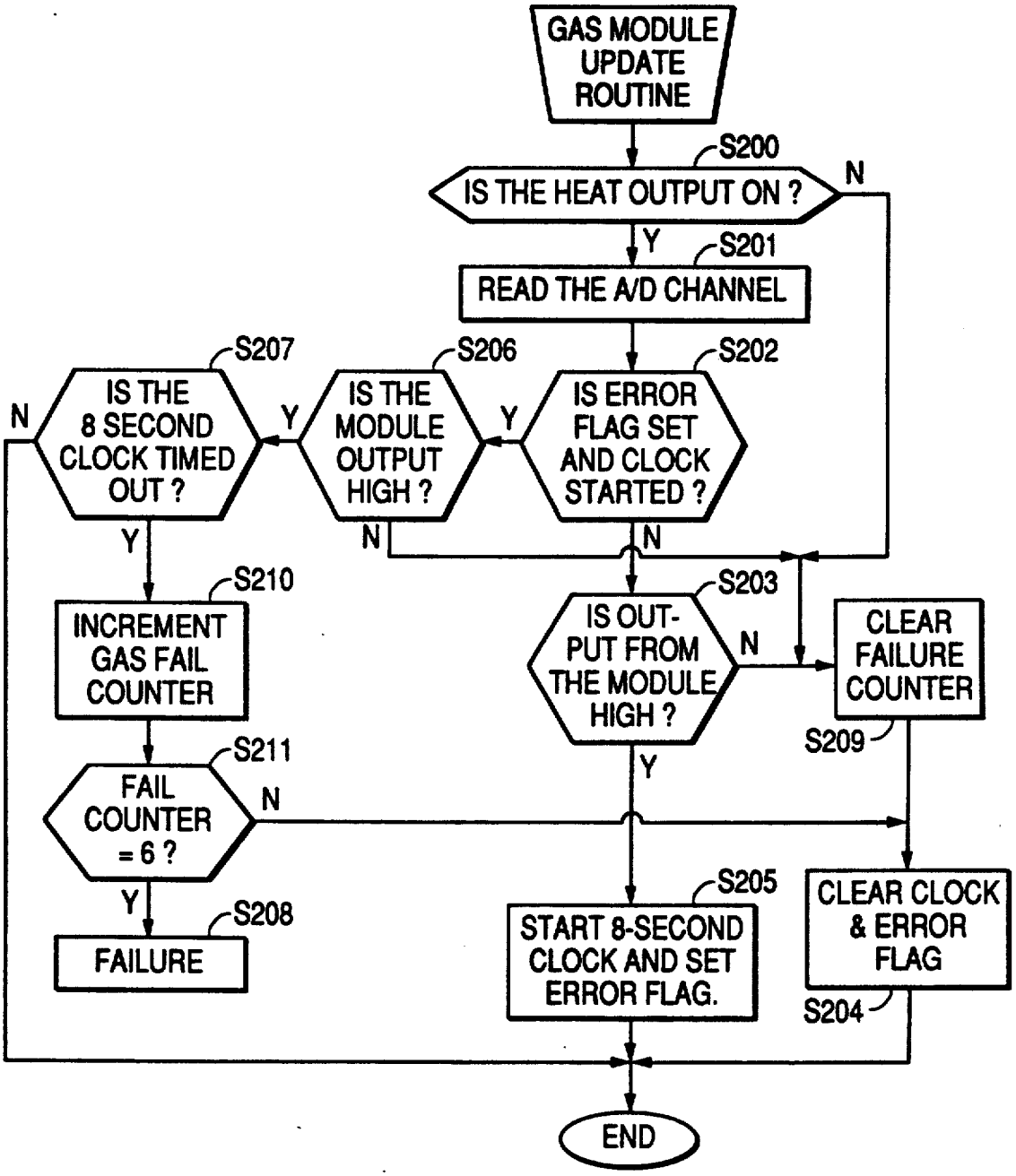
FIG. 5 is a flow chart of a Gas Module Update Routine according to a third embodiment of the invention.

A flow chart for the Gas Update Routing for use in conjunction with a third embodiment of the invention is shown in FIG. 5; the accompanying software code is attached as Appendix 3. For simplicity, steps common to FIGS. 4 and 5 are given common reference numerals. FIG. 5 is similar to FIG. 4, with the exception of additional steps 209–211.

In the third embodiment, a gas failure counter is provided to indicate the number of times a gas ignition failure has occurred. The purpose of this counter is to prevent false detection of ignition failure. As can be seen from FIG. 5, each time the 8-second clock times out, the gas failure counter is incremented (Step 210). After a certain number of indications of gas ignition failure (Step 211), the system indicates an error, prevents further ignition attempts, and alarms the user (Step 208). Finally, Step 209 clears the gas failure counter at appropriates times. In the preferred embodiment, step 211 reacts to six (6) gas ignition failure detections by preventing further ignition attempts and alarming the user. Of course, the counter at step 211 can be modified to respond to any number of gas ignition failure detections depending on the desired sensitivity of the failure detection system By use of the gas failure counter, the sensitivity can be easily adjusted for a given system.

The above has been a description of the preferred embodiments of the present invention; however, various modifications will be apparent to one of ordinary skill in the art without departing from the scope and spirit of the invention. For example, the actual output of the gas ignition module to the gas valve could be monitored if the logic was reversed in software or hardware. Also, the control system could be used in a non-pulsed or continuous power heat mode. In that case, there would no longer be a danger of gas accumulation. However, the advantage of indicating an ignition failure to a user would still be present. The scope of the invention is only to be limited by the appended claims.

APPENDIX 1

```
*****************************************************************
* GasModUp
* SUBROUTINE TO UPDATE THE Gas Module INPUT
*
* Module Description:  This module is called to monitor the state of the
*                      Gas Module Lockout output.  If either burner (left
*                      or right) fails to light within a specified time
*                      length, the gas module lockout output goes high and
*                      stays high.  This will trigger an "E20" error
*                      (Gas Module Failure).
*
* I/O:
*                      INPUTS:  TEMPAD, CHANNEL,MISLED,MSFLGS
*                               GASCLK
*                     OUTPUTS:  ERRBYT, CHANNEL,GASCLK,MSLFGS
*
* OTHER ROUTINES CALLED:       REDAZD
* MACHINE EXIT STATE:          ACCUM. A, ACCUM. B, X-REG., CCR - INDETERMINATE
*
*
* CREATE DATE:
* REVISION DATE:
* REVISION LEVEL:              A
* REVISION RECORD:             A - ORIGINAL
*****************************************************************

* CHECK TO SEE IF THE HEAT OUTPUT IS ON

GasModUp:
        LDAA    MISLED2
        ANDA    #$40
        BEQ     CLRGAS                  ;NOT CLEAR THE GAS CLOCK AND IND. BYTE

* IF SO, READ THE A\D AND SEE IF IT IS HIGH
```

```
GASCZK: LDAA    #70
        STAA    CHANNEL                 :CHANNEL 7 IS HIGH LIMIT INPUT

* CALL SUB TO READ THE A/D

        JSR     READA2D
        LDAB    TEMPAD

* HAVE WE SEEN THE FIRST ATTEMPT TO LIGHT?

        LDAA    MSFLGS
        ANDA    #$20
        BNE     CHEC2

* DO WE HAVE A 1ST HIGH

        LDAA    MSFLGS
        ANDA    #$10
        BNE     LOCZEK                  :IF SO CHECK FOR LOW

* HANDLE RESULTS PROPERLY

        CMPB    #$80                    :CHECK FOR MIDPOINT DIGITAL INPUT
        BLO     HLEND                   :IF THE OUTPUT IS LOW THEN END

* MARK START OF 1ST HIGH

        LDAA    MSFLGS
        ORAA    #$10
        STAA    MSFLGS
        LDAA    #50
        STAA    GASCLK+1
        CLR     GASCLK
        LDAA    MSFLGS
        ANDA    #$FB
        STAA    MSFLGS
        BRA     HLEND

* CHECK FOR LOW AFTER 1ST HIGH

LOCZEK: LDAA    MSFLGS
        ANDA    #$04
        BNE     ENDLO                   :IF TIMED OUT DO WE NOW HAVE A LOW

* DO WE HAVE A LOW DURING 5 SECONDS?

        CMPB    #$80
        BLO     CLRGAS                  :IF SO RESET
        JMP     HLEND                   :ELSE END

ENDLO:  CMPB    #$80
        BHI     HLEND

* ITS LOW MARK IT AND NOW CHECK FOR NEW HIGH WITH LENTGH OF 1 SECOND

        LDAA    MSFLGS
        ORAA    #$20
        STAA    MSFLGS                  :MARK 1ST ATTEMPT TO LIGHT

* IS THE CLOCK RUNNING FOR ANOTHER HIGH?

CHEC2:  LDAA    MSFLGS
        ANDA    #$04
        BEQ     HICK                    :IF RUNNING CHECK FOR 1 SECOND LEFT

* IS THE OUTPUT HIGH?

        CMPB    #$80
        BLO     HLEND

* ITS HIGH, START THE CLOCK

        LDAA    #20
        STAA    GASCLK+1
```

```
        CLR     GASCLK
        LDAA    MSFLG5
        ANDA    #$FB
        STAA    MSFLG5
        BRA     HLEND                   :THEN END

* CHECK TO SEE IF THE OUTPUT IS STILL HIGH AND IF IT HAS BEEN ON FOR 1 SEC

HICK:   CMPB    #$80
        BHI     ONELFT

* VENT LOW BEFORE 1 SECOND ELAPSED STOP CLOCK AND CLEAR ALL FLAGS

CLRGAS: CLR     GASCLK+1
        CLR     GASCLK
        LDAA    MSFLG5
        ORAA    #$04
        ANDA    #$0F
        STAA    MSFLG5
        BRA     HLEND

* OUTPUT IS STILL HIGH HAS 1 SECOND ELAPSED

ONELFT: TST     GASCLK+1
        BNE     HLEND

* SHOW EMHL ERROR

ANEMHL: LDAB    #200                    :AN GAS FAIL CONDITION

* STORE RESULT OF HIGH LIMIT CHECK

STORERR:STAB    ERRBYT                  :STORE RESULT OF HIGH LIMIT QUERRY

* ELSE END ROUTINE

HLEND:  RTS
        PAGE

*****************************************************************************
*****************************************************************************
*****************************************************************************
*****************************************************************************
*****************************************************************************

MAINLIN: LDS    #$FF                    :SET THE STACK POINTER
         JSR    MAINIT                  :DO MAIN INIT
         BRA    HITCLR
REINIT:  JSR    MAINIT                  :DO MAIN INITIALIZATION
         LDAA   HISFLG
         ORAA   #$01                    :SHOW NEW PROGRAM MODE (WHEN ENTERED AGAIN)
*                                       :AND SHOW TIMER SWITCH X-TION (FOR HI-LIM BUZZER OFF)
         STAA   HISFLG
HITCLR:  LDAA   MSFLG3
         ANDA   #$0F                    :CLEAR THE PROGRAM MODE X-ITION BIT
         STAA   MSFLG3
         LDAA   PCTLNM
         STAA   CTLNUM
         STAA   CURCTL

* ARE WE ALREADY IN PROGRAM MODE

CHKMO:   LDAA   MMODE
         BEQ    ISFSEL

* DO THE PROGRAM MODE STUFF

DOPROG:  JSR    PROMOD
         LDAA   SWTMON
         CMPA   #$87                    :ARE WE SUPPOSED TO
         BNE    CHKMO
         LDAA   PMODE
```

```
        CMPA    #3D
        BEQ     CMOMO           :IF IN RESET REVIEW, DON'T EXIT PROGRAM MODE
        CLR     MMODE           :CLEAR THE PROGRAM/COOK MODE BYTE
OKXOOK: LDAA    MSFLG3
        ANDA    #$20
        BNE     PMOOO
        JMP     COOKMO
PMOOO:  TST     PMODE
        BNE     REINIT          :IF NOT CYCLE INFO PROGRAMMING THEN DONT INTERVAL SHUFFLE
        JSR     USECNG          :IF ANY CHANGE BITS SET SAVE THE APPROPRIATE INFO
        JSR     INTSHF          :SHUFFLE THE SAVE INFO
        JSR     COPORG          :COPY THE ORIG INTO COPY AREA
        BRA     REINIT

* UPDATE FOR THE SOFTWARE KEY CODE

* IS THERE A SELECT TIME X-ITION

ISFSEL: LDAA    ERRBYT          :IF WERE IN ERROR HANDLER (FILTER IS IN E.H.)
        BEQ     TIMER           :THEN DON'T ALLOW PROGRAM MODE
        JMP     COOKMO
TIMER:  LDAA    TIMOF
        ANDA    #$01
        BNE     STSWIT          :IF COOK TIMER NOT RUNNING ALLOW PROGRAM MODE
        JMP     COOKMO          :ELSE DON'T
STSWIT: LDAA    SWTMOM
        CMPA    #$81
        BEQ     SPCSTR          :IF SO THEN GO AND SHOW SPECIAL SEQUENCE STARTED
        BRA     CKSPST          :ELSE SEE IF SPECIAL SEQUENCE WAS STARTED ALREADY

*   SHOW THE SPECIAL SEQUENCE STARTED

SPCSTR: LDAA    SPCBYT
        ORAA    #$80
        STAA    SPCBYT
        LDAA    #$01
*       LDAA    #$04
        STAA    SPCSEQ
        STAA    OLESEQ
        LDAA    #10
        STAA    HOLCLK+1
        CLR     HOLCLK
        LDAA    TIMOF
        ANDA    #$7F
        STAA    TIMOF           :START THE ONE SECOND CLOCK
        JMP     COOKMO          :THEN DO COOK MODE STUFF

* WAS SPECIAL SEQUENCE ALREADY STARTED??

CKSPST: LDAA    SPCBYT
        ANDA    #$80
        BNE     INSWIT          :IF SO CHECK FOR AN INVALID SWITCH
        JMP     COOKMO          :ELSE GO AND DO THE COOK MODE (SEQUENCE ABORTED)

* GO AND CHECK FOR AN INVALID SWITCH

INSWIT: INVALB
        TSTB
        BNE     SPCABT          :IF INVALID SWITCH THEN GO AND ABORT SEQUENCE

* MARK THE CHOSEN SWITCH

        MARCHS

* IS THE 1 SECOND CLOCK TIMED OUT ?

        LDAA    TIMOF
        ANDA    #$80
        BEQ     SEQCNG          :IF NOT SEE IF THE SEQUENCE CHANGED

* ABORT THE SEQUENCE

SPCABT: LDAA    SPCBYT
        ANDA    #$2F
        STAA    SPCBYT
```

```
        CLR     SPCSEQ
        CLR     OLESEQ
        JMP     COOKMO          :THEN GO AND DO THE COOK MODE

* HAS THE SEQUENCE CHANGED

SEQCHG: TESSEQ
        TSTB
        BNE     SEQOK           :IF SEQUENCE CHANGED, IS IT OK?
        JMP     COOKMO          :ELSE GO AND DO THE COOK MODE

* IS THE SEQUENCE OK ?

SEQOK:  OKSEQ
        TSTB
        BNE     SPCABT          :IF NOT ABORT THE SEQUENCE

* RESET THE ONE SECOND CLOCK

        LDAA    #10
        STAA    HOLCLK+1
        CLR     HOLCLK
        LDAA    TIMOF
        ANDA    #$7F
        STAA    TIMOF

* CHECK TO SEE IF THE SEQUENCE IS DONE

        LDAA    SPCSEQ
        CMPA    #$0F
        BEQ     MAKSPC          :IF SO MAKE THE MODE = SPECIAL
        JMP     COOKMO          :ELSE GO AND DO THE COOK MODE

* SET THE MODE TO SPECIAL AND END

MAKSPC: LDAA    #$01
        STAA    MMODE           :MAKE MODE SPECIAL
        LDAA    SWTMON
        ANDA    #$0F
        STAA    SWTMON          :CLEAR THE SWITCH MONITOR BYTE PRIOR TO ENTRY OF PROGRAM MODE
        CLR     SPCSEQ
        CLR     OLESEQ
        CLR     SPCBYT
        LDAA    CYLNUM
        STAA    PCYLNM
        JMP     DOPROG

* DO COOK MODE ROUTINE

COOKMO: LDAA    MISLED2
        ANDA    #$C0
        STAA    MISLED2
        LDAA    MOUTBUF
        ORAA    #$80
        STAA    MOUTBUF         :TURN OFF THE PROGRAM LEDS

* INCREMENT AND CHECK FOR TIME TO CHECK SUMS

        INC     RECCNT
        BNE     HETUP           :IF NOT 0 JUST UPDATE THE HEAT
        JSR     DOSUM

* NOW CHECK IN THE COPY AREA

        JSR     SUMCOP

* ARE BOTH OF THE AREAS FOULED?

        LDAA    FOULED
        ANDA    #$03
        BEQ     HETUP           :IF NOT CHECK THE PROBE
        CMPA    #30
```

```
        BNE     ORGFVL          :IF BOTH NOT FOULED SEE IF ORIGINAL IS
        LDAA    CHKSUM
        CMPA    COPSUM
        BNE     METUP           :IF CHECK SUM <> COPY SUM JUST IGNORE
        LDAA    #410
        STAA    ERRBYT          :ELSE GIVE THE "E41"
        BRA     METUP
ORGFVL: CMPA    #$01
        BNE     COPFVL          :IF NOT THE COPY IS FOULED

* COPY THE COPY CUZ THE ORIGINAL IS FOULED

        JSR     COPCOP
        CLR     FOULED
        BRA     METUP

* COPY THE ORIGINAL CUZ THE COPY IS FOULED

COPFVL: JSR     COPORG
        CLR     FOULED

* NOW CHECK THE HEAT IN TEMPERATURE SENSOR

METUP:  JSR     UPROBS          :GO AND UPDATE THE PROBE INPUT

* UPDATE THE HI LIMIT INPUT FOR GAS MODULE FAILURE

        JSR     GasModUp

* UPDATE THE CYCLE SELECT SWITCH INPUT

        JSR     CYCLIN

* TEMPORARILY UPDATE THE LADDER

        JSR     KEYIN

* NOW CHECK TO SEE IF AN ERROR WAS PRESENT AT THE INPUTS

        LDAA    ERRBYT
        BEQ     IDLTYM          :IF ERROR = 0 THEN SEE IF COOK TIMER IS IDLE
        JSR     ERRHAN          :...ELSE DO ERROR HANDLING ROUTINE
        JMP     OUTIT

* SEE IF COOK TIMER IS IDLE (NOT RUNNING)

IDLTYM: LDAA    MISFLG
        ANDA    #$FE
        STAA    MISFLG          :CLEAR THE TIMER SWITCH X-ITION BIT
        LDAA    STINFO          :GET STATE INFORMATION BYTE
        ANDA    #$70            :GET ONLY CURRENT STATE INFO
        BNE     FNDNXT          :IF ITS NOT 0 THEN THE TIMER IS RUNNING....
*                               :..SO GO AND FIND ITS NEXT STATE
CKCYCL: JSR     CYLSEL          :...ELSE CHECK FOR A NEW CYCLE SELECTED

* CHECK TO SEE IF NEWLY SELECTED MODE IS IDLE OR MELT

        LDAA    CYLNUM
        CMPA    #100
        BEQ     UPMET
        CMPA    #110
        BEQ     UPMET           :IF IT IS IDLE OR MELT THEN SKIP THE TIMER STUFF

* FIND THE COOK TIMERS NEXT STATE

FNDNXT: JSR     NXTTIM

* EXECUTE THE TIMERS NEXT STATE

UPSTATS:JSR     EXSTAT

* UPDATE THE HEAT CONTROL
```

```
UPHET:  JSR     METHOD

*  UPDATE THE PRESSURE CONTROL
*  FIRST CHECK TO SEE IF THE COOK TIMER IS RUNNING

        LDAA    TIMOF
        ANDA    #$01
        BNE     OUTIT           :IF WE ARE NOT COOKING, THEN DON'T UPDATE PRESSURE
        JSR     PRSCTL

*  UPDATE ALL THE OUTPUTS

OUTIT:  LDAA    CYLMON
        BMI     BEEPY
        LDAA    SVTMON
        BPL     OUTOK
BEEPY:  LDAA    MOUTBUF
        ANDA    #$DF
        STAA    MOUTBUF
OUTOK:  JSR     UPOUTS

*  ENDLESSLY LOOP TO CONTROL FRYER

        JMP     CHCMD

*  END MAINLINE

        END


*****************************************************************************
*  FLASHIT
*  MACRO TO FLASH ERROR CODE (ALTERNATE WITH BLANKS OR POT TEMPERATURE)
*
*  I/O:            INPUTS:  TIMOF, DBZCLK+1, MISFLG, ADDATA (POTTMP), ERRBYT
*                  OUTPUTS:  DMLST, DM2ND, DM3RD, DMMST, DBZCLK, DBZCLK+1, TIMOF
*
*  ERROR HANDLING:      NONE
*  OTHER MODULES CALLED:        POTDIS
*  MACHINE EXIT STATE:          ACCUM. A,ACCUM. B, X-REG., CCR - INDETERMINATE
*
*
*  CREATE DATE:
*  REVISION DATE:
*  REVISION LEVEL:      B
*  REVISION RECORD:     A - ORIGINAL
*                       B - added "E20" error for Gas Module Monitoring
*****************************************************************************

*  CHECK TO SEE IF FLASHER CLOCK IS RUNNING

FLASHIT:.MACRO

        LDAA    ERRBYT
        CMPA    #60
        BNE     GTIMOF#

*  PUT "Prob" IN THE DISPLAY

        LDAA    PEE
        STAA    DMMST
        LDAA    AHRE
        STAA    DM3RD
        LDAA    OH
        STAA    DM2ND
        LDAA    BEE
        STAA    DMLST
        JMP     ENDFLS#

GTIMOF#:        LDAA    TIMOF           :GET STATUS OF TIME OUT FLAGS
        ANDA    #$10            :CHECK JUST THE FLASHER CLOCK
        BEQ     CKHALF#         :IF ALREADY RUNNING THEN SEE IF 1/2 WAY TIMED OUT
```

```
* ...ELSE PUT 6 SECONDS IN THE CLOCK AND START IT

        LDAA    #$06
        STAA    DBZCLK+1        :PUT IT IN THE DISPLAY/BUZZER CLOCK
        CLR     DBZCLK          :MAKE SURE THERE IS NOTHING IN THE 1/10 PART OF
*                               :THE DISPLAY/BUZZER CLOCK
        LDAA    TIMOF           :GET TIME OUT FLAG STATUS
        ANDA    #$EF            :START CLOCK
        STAA    TIMOF

* CHECK TO SEE IF CLOCK IS 1/2 WAY TIMED OUT (3 SECONDS OR LESS)

CKHALF#:LDAA    DBZCLK+1        :GET CLOCK STATUS
        CMPA    #$03            :IS IT 3 SECONDS ?
        BLO     PTORBL#         :IF 3 OR LESS SHOW EITHER POT TEMP OR BLANKS

* SHOW ERROR CODE FOR 3 SECONDS

        LDAA    #$0E            :PUT AN "E" IN 3RD DIGIT
        STAA    DM3RD
        LDAA    #$10            :BLANK OUT MOST SIGNIF. DIGIT
        STAA    DMMST
        LDAA    ERRBYT          :PUT ERROR CODE (WHICH IS < 9) IN 1ST DIGIT
        CMPA    #200
        BNE     TENNN#
        LDAA    #20
        STAA    DM2ND
        CLR     DMLST
        JMP     ENDFLS#
TENNN#: CMPA    #100
        BLO     LOSTR#
        CMPA    #100
        BHI     PUT41#
        LDAB    #10
        STAB    DM2ND
        SUBA    #100
        STAA    DMLST
        BRA     ENDFLS#
PUT41#: CMPA    #410
        BEQ     OK441#
        CLR     ERRBYT
        BRA     ENDFLS#
OK441#  LDAA    #$04
        STAA    DM2ND
        LDAA    #$01
        STAA    DMLST
        BRA     ENDFLS#
LOSTR#: STAA    DMLST
        CLR     DM2ND           :PUT A "0" IN THE 2ND DIGIT
        BRA     ENDFLS#         :THEN END ROUTINE

* SEE IF WE SHOULD BE DISPLAYING POT TEMP OR BLANKS

PTORBL#:LDAA    MISFLG          :GET STATUS OF MISC. FLAG BUFFER
        ANDA    #$01            :CHECK TO SEE IF TIMER SWITCH X-ITION BIT IS SET
        BEQ     BLANKIT#        :IF NOT JUST SHOW BLANKS

* ...ELSE SHOW POT TEMP. IN ALTERNATE FLASHES

        POTDIS
        BRA     ENDFLS#         :THEN END THE ROUTINE

* SHOW BLANKS WITH ERROR CODE

BLANKIT#:LDAA   #$10
        STAA    DMLST
        STAA    DM2ND
        STAA    DM3RD
        STAA    DMMST

* END FLASHIT MACRO

ENDFLS#:.EMON
        PAGE
```

APPENDIX 2

```
        LIST    ON
        SYMBOLS ON
        TITLE   KFC PROCESS CONTROLLER UPDATE INPUTS ROUTINE

        EXTERNAL        REDA2D,SVTMON,TEMPAD,CHANNEL,ADDATA,TMPSW2,RTDLIN
        EXTERNAL        CYLMON,BWNCLK,MSFLG2,TMPSWC,MSFLG3,BWN2CK,RESUN
        EXTERNAL        GASFAL,GASCLK,MISLED2,MSFLG5,ERRBYT

        GLOBAL          UPROBS,KEYIN,CYCLIN,UPHLIN

        PAGE
*****************************************************************************
*  GasModUp
*  SUBROUTINE TO UPDATE THE Gas Module INPUT
*
*  Module Description:  This module is called to monitor the state of the
*                       Gas Module Lockout output.  If either burner (left
*                       or right) fails to light the gas module lockout
*                       output goes high.  In the event that this signal
*                       stays high for more than 8 seconds, the control
*                       will signal an "E20" error.
*
*  I/O:
*                       INPUTS:  TEMPAD, CHANNEL, MISLED, MSFLG5, GASCLK
*                      OUTPUTS:  ERRBYT, CHANNEL, GASCLK, MSFLG5
*
*  OTHER ROUTINES CALLED:       REDA2D
*  MACHINE EXIT STATE:          ACCUM. A, ACCUM. B, X-REG., CCR - INDETERMINATE
*
*
*  CREATE DATE:
*  REVISION DATE:               6 May  91
*  REVISION LEVEL:              B
*  REVISION RECORD:             A - ORIGINAL
*                               B - Looking for a high of > 8 Seconds.
*****************************************************************************

*  ARE WE CALLING FOR HEAT?

GasModUp:

        LDAA    MISLED2
        ANDA    #$40
        BEQ     CLRGAS                  :NOT CLEAR THE GAS CLOCK AND IND. BYTE

*  IF SO, READ THE A\D AND SEE IF IT IS HIGH

        LDAA    #7D
        STAA    CHANNEL                 :CHANNEL 7 IS HIGH LIMIT INPUT

*  CALL SUB TO READ THE A/D

        JSR     REDA2D
        LDAB    TEMPAD

*  HAVE WE MARKED THE HIGH AND STARTED THE CLOCK

        LDAA    MSFLG5
        ANDA    #$10
        BNE     TOB             :IF SO SEE IF THE 8 SECOND CLOCK IS TIMED OUT

*  IF NOT IS THE OUTPUT HIGH

        TST     TEMPAD
        BPL     CLRGAS          :IF NOT JUST RESET

*  START CLOCK CUZ THE OUTPUT JUST WENT HIGH (AND MARK THE HIGH)

        LDAA    #80
        STAA    GASCLK+1
```

```
        CLR     @ASCLK
        LDAA    MSFLG5
        ANDA    #$FB
        STAA    MSFLG5
        LDAA    MSFLG5
        ORAA    #$10
        STAA    MSFLG5
        BRA     HLEND

* IS THE OUTPUT HIGH

TOB:    TST     TEMPAD
        BPL     CLRGAS          :IF NOT CLEAR CLOCK AND FLAGS

* IS THE EIGHT-SECOND CLOCK TIMED OUT

        LDAA    MSFLG5
        ANDA    #$04
        BNE     GFAIL           :IF SO SHOW A FAILURE

* ELSE OUTPUT IS HIGH AND THE CLOCK IS NOT TIMED OUT SO JUST END

        BRA     HLEND

* CLEAR THE CLOCKS AND MARKERS WE DO NOT HAVE A FAILURE

CLRGAS: CLR     @ASCLK+1
        CLR     @ASCLK
        LDAA    MSFLG5
        ORAA    #$04
        ANDA    #$0F
        STAA    MSFLG5
        BRA     HLEND

* SHOW GAS FAILURE ERROR

GFAIL:  LDAB    #200                    :AN GAS FAIL CONDITION

* STORE RESULT OF HIGH LIMIT CHECK

STORERR:STAB    ERRBYT                  :STORE RESULT OF HIGH LIMIT QUERRY

* ELSE END ROUTINE

HLEND:  RTS
        PAGE
```

APPENDIX 3

```
*****************************************************************************
*  GasModUp
*  SUBROUTINE TO UPDATE THE Gas Module INPUT
*
*  Module Description:  This module is called to monitor the state of the
*                       Gas Module Lockout output.  If either burner (left
*                       or right) fails to light the gas module lockout
*                       output goes high.  In the event that this signal
*                       stays high for more than 8 seconds, six times
*                       in a row, the control will signal an "E20" error.
*
*  I/O:
*                       INPUTS:  TEMPAD, CHANNEL, MISLED, MSFLG5, GASCLK
*                      OUTPUTS:  ERRBYT, CHANNEL, GASCLK, MSFLG5
*
*  OTHER ROUTINES CALLED:       REDA2D
*  MACHINE EXIT STATE:          ACCUM. A, ACCUM. B, X-REG., CCR - INDETERMINATE
*
*
*  CREATE DATE:
*  REVISION DATE:               15 June 91
*  REVISION LEVEL:              B
*  REVISION RECORD:             A - ORIGINAL
*                               B - Looking for a high of > 8 Seconds.
*                               C - Get 6 failures before error indication
*****************************************************************************
```

```
* ARE WE CALLING FOR HEAT?

GasModUp:

        LDAA    MISLED2
        ANDA    #$40
        BEQ     GASCLR                  :NOT CLEAR THE GAS CLOCK AND IND. BYTE

* IF SO, READ THE A\D AND SEE IF IT IS HIGH

GASCZK: LDAA    #7D
        STAA    CHANNEL                 :CHANNEL 7 IS HIGH LIMIT INPUT

* CALL SUB TO READ THE A/D

        JSR     REDA2D
        LDAB    TEMPAD

* HAVE WE MARKED THE HIGH AND STARTED THE CLOCK

        LDAA    MSFLG5
        ANDA    #$10
        BNE     TO6             :IF SO SEE IF THE 8 SECOND CLOCK IS TIMED OUT

* IF NOT IS THE OUTPUT HIGH

        TSTB
        BPL     CLRGAS          :IF NOT JUST RESET

* START CLOCK CUZ THE OUTPUT JUST WENT HIGH (AND MARK THE HIGH)

        LDAA    #8D
        STAA    GASCLK+1
        CLR     GASCLK
        LDAA    MSFLG5
        ANDA    #$FB
        ORAA    #$10
        STAA    MSFLG5
        BRA     HLEND

* IS THE OUTPUT HIGH

TO8:    TSTB
        BPL     CLRGAS          :IF NOT CLEAR CLOCK AND FLAGS

* IS THE EIGHT SECOND CLOCK TIMED OUT

        LDAA    MSFLG5
        ANDA    #$04
        BNE     GFAIL           :IF SO SHOW A FAILURE

* ELSE OUTPUT IS HIGH AND THE CLOCK IS NOT TIMED OUT SO JUST END

        BRA     HLEND

* CLEAR THE CLOCKS AND MARKERS WE DO NOT HAVE A FAILURE

CLRGAS: CLR     GASFAL

GASCLR: CLR     GASCLK+1
        CLR     GASCLK
        LDAA    MSFLG5
        ORAA    #$04
        ANDA    #$CF
        STAA    MSFLG5
        BRA     HLEND

* CHECK FOR 6 CONSECUTIVE FAILURES, IF SO SHOW GAS FAILURE ERROR

GFAIL:  INC     GASFAL
        LDAA    GASFAL
        CMPA    #5D
```

```
        BLO     GASCLR          :IF < 6 JUST TRY AGAIN
        LDAB    #200            :AN GAS FAIL CONDITION

* STORE RESULT OF HIGH LIMIT CHECK

STORERR:STAB    ERRBYT          :STORE RESULT OF HIGH LIMIT QUERRY

* ELSE END ROUTINE

HLEND:  RTS
```

We claim:

1. A system for monitoring and controlling a gas ignition module, which system includes means for providing activation pulses to said gas ignition module, said system comprising:

sensing means for sensing an output of said gas ignition module;

determining means responsive to said sensing means for determining if an ignition module lockout has occurred; and prevention means for preventing said activation pulses in response to a determination by said determining means that an ignition module lockout has occurred.

2. The system of claim 1 wherein said sensing means comprises an optoisolator.

3. The system of claim 1 further including alarm means for alarming a user of the system in response to a determination by said determining means that an ignition module lockout has occurred.

4. The system of claim 3 wherein said alarm means comprises means for activating a visual alarm.

5. The system of claim 3 wherein said alarm means comprises means for sounding an alarm.

6. The system of claim 1 wherein said control system provides for a preheat cycle and an ignition cycle, said preheat cycle preceding said ignition cycle, said determining means determining if an ignition module lockout has occurred in said ignition cycle, and said prevention means preventing said activation pulses in response to a determination by said determining means that an ignition module lockout has occurred in said ignition cycle.

7. A system for monitoring and controlling a gas ignition module, which system includes means for providing activation pulses to said gas ignition module, said system comprising:

sensing means for sensing an output of said gas ignition module;

determining means responsive to said sensing means for determining if an ignition module lockout has occurred; and prevention means for preventing said activation pulses in response to a determination by said determining means that an ignition module lockout has occurred;

wherein said determining means further determines if an ignition module lockout has existed for a predetermined period of time, and said prevention means prevents said activation pulses in response to a determination by said determining means that an ignition module lockout has existed for said predetermined period of time.

8. The system of claim 7 wherein said predetermined period of time is at least eight seconds.

9. A system for monitoring and controlling a gas ignition module, which system includes means for providing activation pulses to said gas ignition module, said system comprising:

sensing means for sensing an output of said gas ignition module;

determining means responsive to said sensing means for determining if an ignition module lockout has occurred; and prevention means for preventing said activation pulses in response to a determination by said determining means that an ignition module lockout has occurred;

wherein said control system provides for a preheat cycle and an ignition cycle, said preheat cycle precedes said ignition cycle, said determines means determining if an ignition module lockout has occurred in said ignition cycle and has existed for a predetermined period of time, and said prevention means prevents said activation pulses in response to a determination by said determining means that an ignition module lockout has occurred in said ignition cycle and has existed for said predetermined period of time.

10. The system of claim 9 wherein said predetermined period of time is one second.

11. A method of monitoring and controlling a gas ignition module comprising:

providing activation pulses to said gas ignition module at predetermined intervals;

monitoring an output of said gas ignition module and determining therefrom if an ignition module lockout has occurred; and halting said activation pulses in response to a determination by said determining step that an ignition module lockout has occurred.

12. The method of claim 11 further comprising the step of indicating to a user of the system the existence of an ignition module lockout as determined by said determining step.

13. The method of claim 12 wherein said indicating step comprises activating a display.

14. The method of claim 12 wherein said indicating step comprises sounding an alarm.

15. The method of claim 11 further comprising providing a preheat cycle and an ignition cycle for said gas ignition module, said preheat cycle preceding said ignition cycle, said determining step determining if an ignition module lockout has occurred in said ignition cycle, and said halting step halting said activation pulses in response to a determination by said determining step that an ignition module lockout has occurred in said ignition cycle.

16. A method of monitoring and controlling a gas ignition module comprising:

providing activation pulses to said gas ignition module at predetermined intervals;

monitoring an output of said gas ignition module and determining therefrom if an ignition module lockout has occurred; and halting said activation pulses in response to a determination by said determining step that an ignition module lockout has occurred;

wherein in said determining step, it is further determined whether an ignition module lockout has existed for a predetermined period of time, and said halting step halts said activation pulses in response to a determination by said determining step that an ignition module lockout has existed for said predetermined period of time.

17. The method of claim 16 wherein said predetermined period of time is at least eight seconds.

18. A method of monitoring and controlling a gas ignition module comprising:

providing activation pulses to said gas ignition module at predetermined intervals;

monitoring an output of said gas ignition module and determining therefrom if an ignition module lockout has occurred;

halting said activation pulses in response to a determination by said determining step that an ignition module lockout has occurred; and further comprising the step of providing a preheat cycle and an ignition cycle for said gas ignition module, said preheat cycle preceding said ignition cycle, wherein in said determining step it is determined whether an ignition module lockout has occurred in said ignition cycle for a predetermined period of time, and said halting step halts said activation pulses in response to a determination by said determining step that an ignition module lockout has occurred in said ignition cycle for said predetermined period of time.

19. The method of claim 18 wherein said predetermined period of time is one second.

20. A system for monitoring and controlling a gas ignition module, which system includes means for providing activation pulses to said gas ignition module, said system comprising:

sensing means for sensing an output of said gas ignition module;

determining means responsive to said sensing means for determining if an ignition module lockout has occurred; and alarm means for alarming a user of the system in response to a determination by said determining means that an ignition module lockout has occurred.

21. The system of claim 20 wherein said alarm means comprises means for activating a visual alarm.

22. The system of claim 20 wherein said alarm means comprises means for sounding an alarm.

23. A method of monitoring and controlling a gas ignition module comprising:

providing activation pulses to said gas ignition module at predetermined intervals;

monitoring an output of said gas ignition module and determining therefrom if an ignition module lockout has occurred; and indicating to a user of the system the existence of an ignition module lockout as determined by said determining step.

24. The method of claim 23 wherein said indicating step comprises sounding an alarm.

25. The method of claim 23 wherein said indicating step comprises activating a display.

26. A system for monitoring and controlling a gas ignition module means for providing activation pulses to said gas ignition module, said system comprising:

control means external to said gas ignition module means for determining if a lockout has occurred, said control means including;

gas failure counter means for counting the number of times a gas ignition failure has occurred; and prevention means for preventing said activation pulses in response to a predetermined count of said gas failure counter means.

27. A system for monitoring and controlling a gas ignition module, which system includes means for providing activation pulses to said gas ignition module, said system comprising:

sensing means for sensing an output of said gas ignition module;

determining means responsive to said sensing means for determining if an ignition module lockout has occurred; and prevention means for preventing said activation pulses in response to a determination by said determining means that an ignition module lockout has occurred; wherein said determining means comprises a gas failure counter means for counting the number of times a gas ignition failure has occurred.

28. A method of monitoring and controlling a gas ignition module comprising:

providing activation pulses to said gas ignition module at predetermined intervals;

monitoring an output of said gas ignition module and determining therefrom if an ignition module lockout has occurred; and halting said activation pulses in response to a determination by said determining step that an ignition module lockout has occurred;

wherein said monitoring step comprises the step of counting the numner of times a gas failure has occurred and said halting step is responsive to a predetermined number of gas failures.

• • • • •